US005232241A

United States Patent [19]

Knott et al.

[11] Patent Number: 5,232,241

[45] Date of Patent: Aug. 3, 1993

[54] SNOW SKI WITH INTEGRAL BINDING ISOLATION MOUNTING PLATE

[75] Inventors: Walter P. Knott, Tacoma; Steven C. Sunde; Paul W. Norton, both of Vashon, all of Wash.

[73] Assignee: K-2 Corporation, Vashon, Wash.

[21] Appl. No.: 840,019

[22] Filed: Feb. 24, 1992

[51] Int. Cl.[5] ..... A63C 9/00

[52] U.S. Cl. ..... 280/607; 280/610; 280/617

[58] Field of Search ..... 280/607, 610, 617, 609, 280/602

[56] References Cited

U.S. PATENT DOCUMENTS

| | | | |
|---|---|---|---|
| 2,560,693 | 7/1951 | Hickman | 280/602 |
| 3,498,626 | 3/1970 | Sullivan | 280/602 |
| 3,635,482 | 1/1972 | Holman | 280/610 |
| 3,671,054 | 6/1972 | Mittelstadt | 280/607 |
| 3,844,576 | 10/1974 | Schultes | 280/610 |
| 3,861,699 | 1/1975 | Molnar | 280/610 |
| 3,901,522 | 8/1975 | Boehm | 280/610 |
| 3,915,466 | 10/1975 | Matsuda | 280/607 |
| 3,917,298 | 11/1975 | Haff | 280/617 |
| 3,928,106 | 12/1975 | Molnar | 156/210 |
| 3,997,178 | 12/1976 | Altenburg | 280/615 |
| 4,141,570 | 2/1979 | Sudmeier | 280/607 |
| 4,294,460 | 10/1981 | Kirsch | 280/607 |
| 4,349,212 | 9/1982 | Svoboda | 280/610 |
| 4,438,948 | 3/1984 | Gertsch | 280/618 |
| 4,639,009 | 1/1987 | Meatto et al. | 280/602 |
| 4,671,529 | 6/1987 | LeGrand et al. | 280/610 |
| 4,896,895 | 1/1990 | Bettosini | 280/618 |
| 5,056,807 | 10/1991 | Comert et al. | 280/616 |

FOREIGN PATENT DOCUMENTS

| | | | |
|---|---|---|---|
| 0104185 | 5/1987 | European Pat. Off. . | |
| 3934888 | 5/1990 | Fed. Rep. of Germany . | |
| 3934891 | 5/1990 | Fed. Rep. of Germany . | |
| 3937617 | 7/1990 | Fed. Rep. of Germany | 280/607 |

*Primary Examiner*—Richard M. Camby
*Attorney, Agent, or Firm*—Christensen, O'Connor, Johnson & Kindness

[57] ABSTRACT

A snow ski has a main body with a recess located in the central portion of the top surface of the ski. The recess is adapted to receive a complementary shaped ski binding mounting plate which is bonded to an intermediate layer of viscoelastic material, which is, in turn, bonded to the main body of the ski. The ski binding mounting plate has a thickness such that the fasteners used to hold the ski binding thereon do not extend through the mounting plate into the body of the ski. The body of the ski may also include reinforcing material in the central portion of the ski containing the recess.

18 Claims, 2 Drawing Sheets

SNOW SKI WITH INTEGRAL BINDING ISOLATION MOUNTING PLATE

TECHNICAL FIELD

The present invention relates to snow skis or snow boards that are adapted to be ridden and which have bindings mounted thereon. In particular, the present invention relates to fiber reinforced skis such as those formed by the wet wrap or torsion box process wherein a wooden or foam plastic core is wrapped with a fiber-reinforced sheet impregnated with resin, and then cured under pressure in a mold with a base assembly. The term "fiber reinforced" is meant to include any high modulus fibrous materials such as glass, aramid fibers such as Kevlar TM, graphite, metal wire, polyester, etc.

BACKGROUND OF THE INVENTION

High performance skis are carefully designed in order to give the user maximum control during skiing. This includes designing the skis to cleanly "carve" turns; that is, during the carving of a turn, every point on the edge of the ski is designed to pass over a single point on the snow. In order to accomplish this, skis are shaped with curved edges such that the waist portion of the ski is narrower than the shovel or tail portions of the ski. In addition to the exterior shape of the ski, the structural core of the ski is carefully tailored such that the ski has the ability to smoothly flex over its length during the carving of a turn.

During skiing, a snow ski flexes continuously both in response to irregularities in the snow and in response to the user's movements, such as during turning. Flexing of a fiber-reinforced ski causes the various layers of fiberglass and other materials that make up the body of the ski to shear with respect to each other. Elements of the ski which effect the interlaminar shear of the materials that make up the ski affect the resulting flex of the ski. As discussed above, skis are designed to flex freely over their length and in accordance with certain desired flex patterns. Elements of the ski that interfere with such flex patterns undesirably affect the performance of the ski.

Mounting ski bindings on the upper surface of skis and positioning relatively rigid boots within the bindings are known to interfere with the desired flex patterns of the ski. Ski bindings are typically mounted on the top surface of the narrowed waist portion of the ski through the use of screw-type fasteners that extend through the top surface of the ski downward into the core of the ski. A number of fasteners are typically used to hold both the toe piece and heel piece of the binding to the ski. Each of these fasteners pierce the layers of fiberglass and other materials positioned within the body of the ski. This compresses the layers of the ski together and reduces their ability to shear with respect to each other during flexing of the ski. Furthermore, the positioning of a rigid plastic ski boot between the toe and heel pieces of a ski binding tends to prevent the ski from flexing in the area beneath the ski boot, thus creating an inflexible "flat" spot in the ski. The introduction of a "flat" or relatively inflexible portion to the center of the ski reduces the ability of the ski to flex over its length, thus affecting the ski's ability to carve a smooth turn.

A related problem is the tendency of screw-type fasteners, used to hold the bindings to the ski, to pull out of the ski under the significant stresses commonly encountered during skiing. Metal reinforcing plates, such as those shown in U.S. Pat. Nos. 3,498,626; 3,635,482; 3,671,054; 3,844,576; 3,861,699; 3,901,522; 3,917,298; 3,928,106; 4,349,212; 4,639,009; and 4,671,529, are commonly used to provide a base element within the body of the ski into which the fasteners may be screwed and held. This helps to solve the problem of fastener pullout but increases the problems related to ski flexing, due to the introduction of a very stiff element to the narrowed waist portion of the ski.

A number of prior art patents attempt to deal with the problems associated with mounting bindings on a ski. U.S. Pat. No. 2,560,693 discloses a separate foot plate system for allowing a ski to flex uniformly over its entire length. This foot plate system is screwed directly into the body of the ski at its ends, consequently, the screws which mount the foot plate system to the skis compress the various layers that make up the body of the ski. Furthermore, the foot plate system raises the bindings and boots off of the upper surface of the ski, thus affecting the ski's performance.

U.S. Pat. No. 4,141,570 discloses the use of an elevated platform to allow the ski to flex between platform supports. However, the platforms themselves are screwed into the body of the ski thus creating the same problems described above. U.S. Pat. No. 3,997,178 discloses a cross-country ski having a two-layer core with the uppermost layer of the core consisting of wood having a thickness of at least 1.5 mm at its thickest part. The wood upper layer stiffens and increases the resistance of the ski to bending and also acts to prevent the binding screws which extend through the plate into the core of the foam plastic ski from being torn out during skiing.

Another system that attempts to reduce the problems caused by mounting bindings on a ski is the so-called "Derby Flex" system described in PCT Patent No. CH83/00039. This system comprises an aluminum plate overlying a hard rubber substrate. The aluminum plate spans the narrowed waist portion of a ski and allows ski bindings to be screwed directly through the aluminum plate and into the rubber substrate rather than directly into the core of the ski. The aluminum plate, however, is screwed directly into the ski at each end in order to attach the aluminum plate to the ski. Consequently, the screws mounting the aluminum plate compress the layers of material forming the body of the ski, thus interfering with the interlaminar shear between the layers of the ski. Furthermore, the Derby Flex system raises the bindings and ski boot away from the body of the ski, thus changing the profile and influencing the performance of the ski.

In addition to flexing of the ski, vibrations in the ski affect both the performance and the comfort of the ski during use. A highly vibratory ski is not as responsive in precise turns, especially on icy slopes. In addition, high frequency vibrations in skis, approximately 150 Hz and above, tend to be transmitted through the binding to the ski boot and user.

German Patent No. 3,934,888 discloses a system for reducing shock and vibration between a ski and a ski binding through the use of a damping plug recessed into a chamber in the body of the ski. German Patent No. 3,934,891 discloses the placement of a viscoelastic layer on the top surface of a ski in between the ski and binding. The binding screws extend through the viscoelastic layer and into the structural layers which make up the body of the ski.

One goal of the present invention is to reduce the effects of the mounting of ski bindings and ski boots on a ski upon the flex patterns of the ski. A related goal is to reduce the transmission of shock and vibration between a ski and a ski binding and ski boot mounted thereon. The present invention achieves this goal without changing the side profile of the ski or adding additional mounting plates to the top of the ski.

SUMMARY OF THE INVENTION

The present invention provides a unique ski construction including an integral binding mounting plate having a thickness sufficient to fully encompass the depth of the binding mounting screws so that the screws do not pass into the body of the ski. A layer of viscoelastic material is positioned between the binding mounting plate and the body of the ski and bonded to each of these elements, whereby the binding mounting plate is both held in place and isolated from the ski body.

The body of the ski of the present invention is designed to flex uniformly along its length to allow for the precise carving of turns. The mounting of ski bindings and boots on the isolated binding mounting plate reduces their interference with the flex patterns of the ski. An integral ski binding mounting plate is thus provided that helps to allow the ski to flex independently of the binding system. The binding mounting plate of the present system accepts most current bindings irrespective of size or shape.

In one embodiment, the ski body is provided with a recess in its top surface adjacent to the narrowed waist portion of the ski. The binding mounting plate is correspondingly shaped to fill the recess in a manner such that the conventional smooth curved top surface of a ski is achieved.

If desired, additional flexible reinforcing material such as fiberglass cloth or mat, or thin sheets of aluminum or steel, may be placed in the narrowed waist portion of the ski to locally strengthen the ski and ensure uniform flexing along its length.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
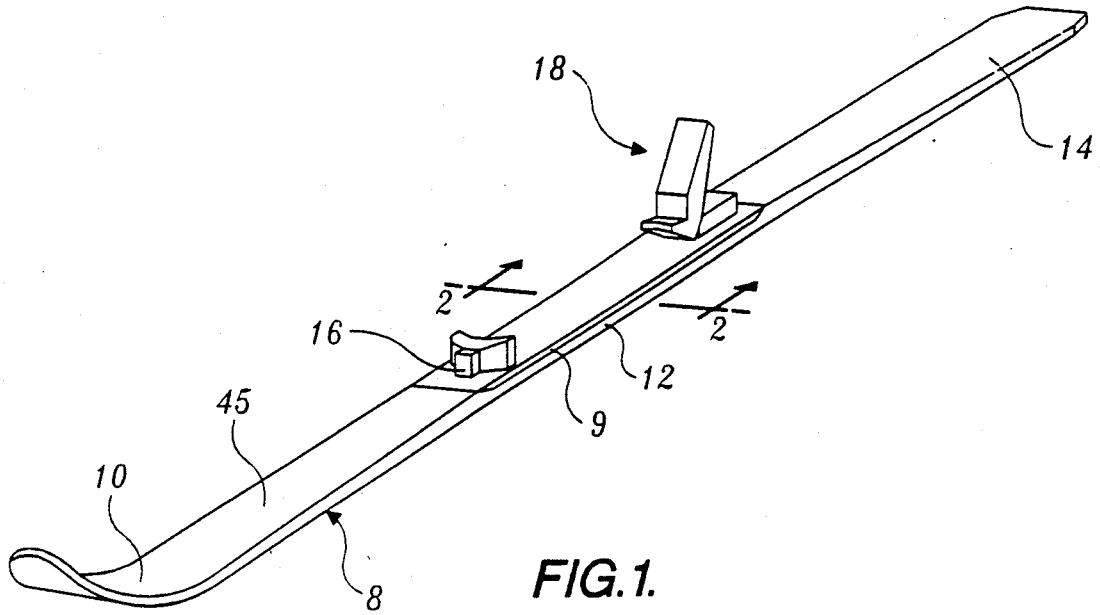
FIG. 1 is a perspective view of a snow ski with an integral binding isolation mounting plate according to the present invention.

FIG. 1 illustrates a snow ski comprising a ski body 8 and an integral binding isolation system 9 according to the present invention. The ski body is formed with an upturned shovel portion 10 which prevents the front of the ski from digging into the snow. The body narrows as it progresses longitudinally along its length until it reaches a narrowed waist portion 12 at which point it extends longitudinally and widens into a tail portion 14. As described above, this exterior shape helps the ski carve a proper turn in which the ski turns around a single point in the snow.

Figure 2:
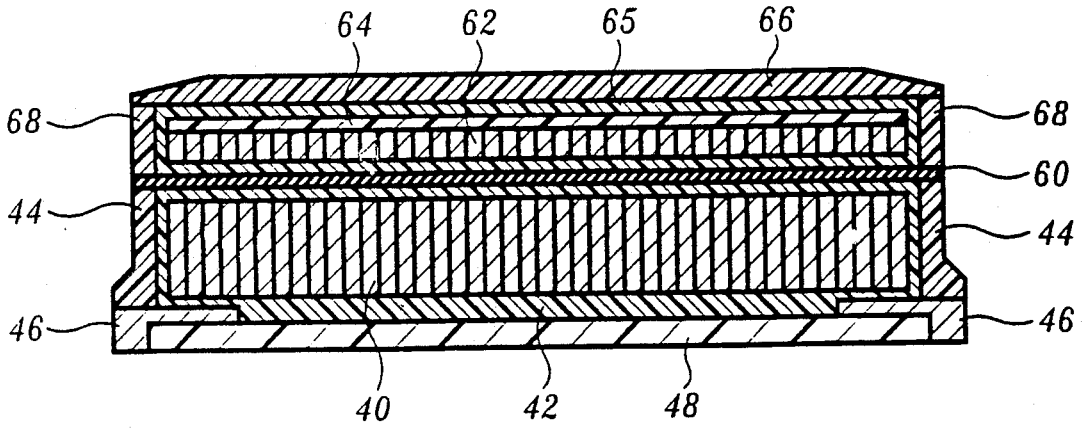
FIG. 2 is a cross-sectional view of the binding isolation mounting plate and ski of FIG. 1.

As illustrated in FIG. 2, the body of the ski comprises a structural but flexing core 40 which has been shaped to form the shovel portion, waist portion and tail portion of the ski. The core 40 can be formed of any suitable material commonly used in ski fabrication, including wood, a honeycomb metal structure, structural foam, etc. In order to strengthen and stiffen the core, it is desirable to wrap the core 40 with a fiber reinforced layer 42. The fiber reinforced layer could include a triaxially braided composite structure as described in U.S. Pat. No. 4,690,850 (Fezio), a fiber reinforced cloth, a filament wound structure, layers of unidirectional fiber reinforced prepreg or other suitable reinforcement materials.

A number of high modulus fibrous materials can be used to form the reinforced layer 42, including glass, graphite, aramid fibers such as Kevlar TM, metal wire and polyester to name a few. The reinforced layer 42 may be formed of a fibrous material that has been preimpregnated with a matrix system, or may be formed of dry fibers which are later impregnated with a matrix. Possible matrix systems include epoxy resins, other adhesive systems, thermoplastic matrix systems, or other suitable high strength, flexible matrix systems.

The number of layers of material, fiber orientations in each layer, and thickness of each material used to reinforce the core 40 are carefully determined to ensure that the finished ski will have the proper structural characteristics. This includes designing the ski such that it has the proper vibration characteristics, can withstand the structural loads present in the application and can properly flex in order to give the ski the ability to cleanly carve a turn.

In order to protect the core 40 and reinforced layer 42, and to cosmetically enhance the ski, protective side walls 44 and top layer 45 may be placed on the vertical side surfaces and top layer, respectively, of the combined core assembly. In the preferred embodiment, the side walls and top layer are formed of a durable protective material such as ABS or ABS/urethane. However, any suitable material that can withstand the harsh temperature environment and punishment experienced by a ski may be used, such as plastics or metals.

In order to achieve high performance, the lower edges of a ski must be able to cut into the snow and ice to allow the skier to perform a turn. Therefore, it is desirable that the lower edges of the ski be formed of a material which can achieve this goal. In the preferred embodiment, two steel edges 46 are placed at the lower corners of the ski. The edges extend longitudinally along the length of the ski and can be formed of any material which creates a durable, sharp edge capable of cutting into snow and ice. The cutting edges 46 are typically formed of steel alloys capable of holding a sharp cutting edge.

To increase performance, a smooth, slick running surface 48 is placed upon the lower surface of the core assembly. The running surface can be formed of any appropriate material which creates a smooth friction-free running surface that allows the ski to move freely over the snow and ice. In the preferred embodiment, sintered polyethylene is used to form the running surface, however other plastics or Teflon TM materials could also be used.

Figure 3:
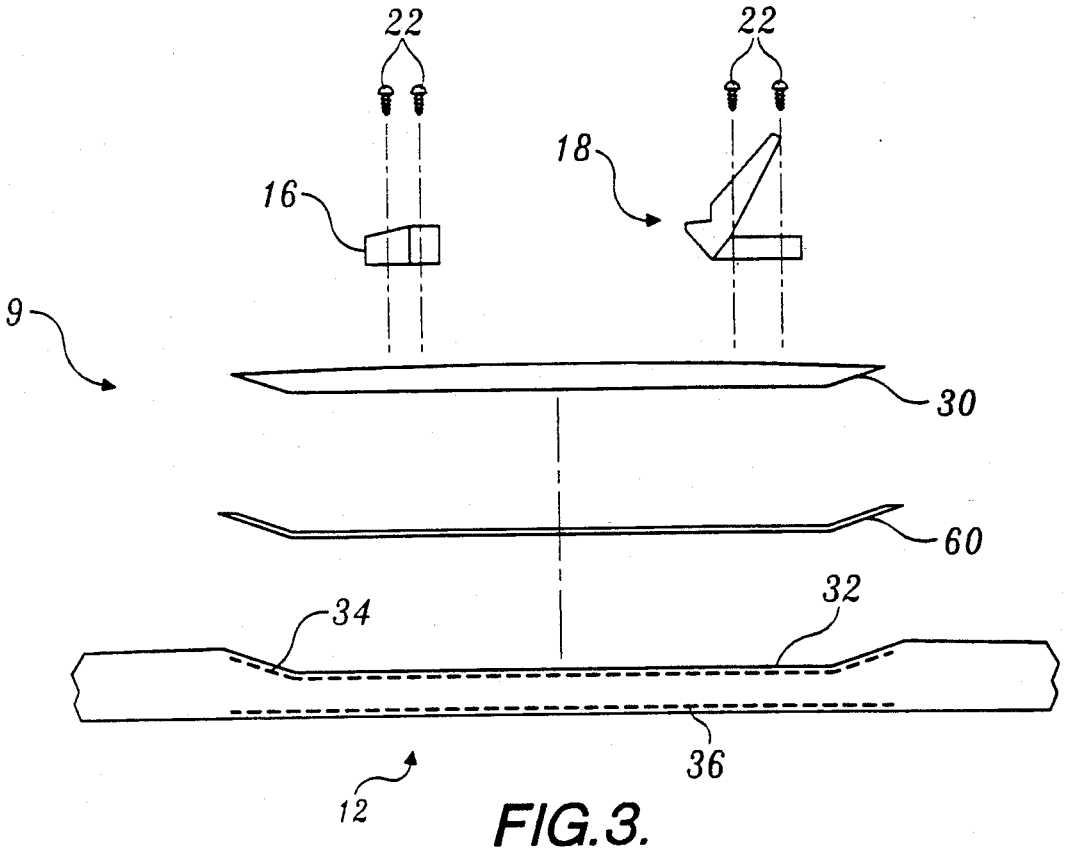
FIG. 3 is an enlarged exploded side elevational view of the binding isolation mounting plate of FIG. 1.
Figure 4:
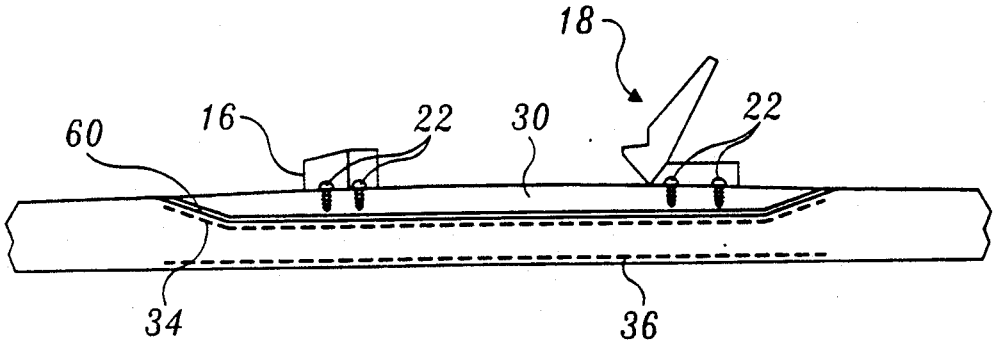
FIG. 4 is an enlarged side elevational view of the binding isolation mounting plate of FIG. 1 after it has been attached to the body of the ski.

According to the present invention, the body 8 of the ski is formed with an integral binding isolation system 9. The isolation system comprises a recess 32 located on the top surface of the ski in the narrowed waist portion 12 (FIGS. 3 and 4). A layer 60 of viscoelastic material is placed in the recess 32 between the body of the ski and a binding mounting plate 30. The recess 32, layer 60 and mounting plate 30 are formed such that they establish a smooth upper surface of the ski, i.e., the upper surface of the mounting plate forms a smooth continuation of the upper surface of the body of the ski at opposite ends of the recess.

The term "viscoelastic" as used herein means any material capable of storing energy of deformation, and in which the application of a stress gives rise to a strain that approaches its equilibrium value slowly, an example of which is rubber.

An adhesive material capable of bonding the layer 60 to the mounting plate and body of the ski is placed on both surfaces of the layer. The adhesive material could be any material capable of properly bonding the viscoelastic material used to the body of the ski and the binding plate, such adhesives could include epoxy resins, rubber cements or other adhesive systems. The layer 60 may be formed of any suitable viscoelastic material such as urethane or rubber, and the bonding adhesive may be an epoxy resin.

The thickness of the viscoelastic layer 60 should be determined based upon two parameters. First, the thickness of the viscoelastic material should be determined such that the finished ski, complete with bindings and attached ski boot is capable of flexing in a desired manner over the entire length of the ski. Additionally, the thickness of the viscoelastic material should be determined such that, as the body of the ski flexes, the interlaminar stress present between the body of the ski, viscoelastic material, and binding plate are not so high as to destroy the bonds holding the separate parts of the ski together. In general, the thickness of the viscoelastic layer depends on the choice of material used and the amount of isolation and damping desired. In one preferred embodiment, the viscoelastic material is urethane having a thickness of 0.010 inches, but it should be understood that a layer having a thickness in the range of 0.005 to 0.05 inches would be satisfactory.

The viscoelastic material allows the mounting plate 30 to be connected to the body of the ski such that the ski is free to flex without being rigidly restricted by the mounting plate 30. In this design, when the body of the ski flexes, the resulting deformation and interlaminar stress between the body of the ski and mounting plate are contained primarily within the viscoelastic material forming the layer 60. This allows the binding to be mounted to the ski such that it is not rigidly secured along its length to the body of the ski, and instead the body of the ski is free to flex independently of the binding and mounting plate 30.

In alternate embodiments, not shown, some portions of the mounting plate 30 could extend through the viscoelastic layer 60 to provide added stability for the mounting plate 30 with respect to the body of the ski. However, in these embodiments, these portions of the mounting plate should not be rigidly connected to the body of the ski and should therefore ideally not be fixedly attached to the body of the ski.

In order to strengthen the ski and for the body of the ski to flex over its length in a desired flex pattern, it may be beneficial to reinforce the narrowed waist portion of the ski containing the recess 32. The decreased cross-sectional area at the recess 32 could result in the ski being weaker and more flexible along the length of the recess than elsewhere along the length of the ski. This could result in the ski having an undesirable flex pattern and, consequently, poor ability to a turn. It may be beneficial, therefore, to reinforce the narrowed waist portion of the ski containing the recess 32 by placing a reinforcing layer 34 along the upper surface of the core and/or a reinforcing layer 36 along the lower surface of the core. The reinforcing layers 34 and 36 could be additional layers of fiberglass or other materials with the same stiffness as the rest of the layers 42, or the reinforcing layers 34 and 36 could be formed of a higher modulus material such as graphite. The thickness and materials used to reinforce the section of the ski containing the recess 32 should be selected such that the finished ski flexes in a continuous curve along its length during turning.

The mounting plate 30 is formed similarly to the body of the ski. A center core 62 (FIG. 2) is formed to the proper shape and is then overlaid by a reinforcing layer 65. The reinforcing layer could be a triaxially braided composite structure, a fiber reinforced cloth, a filament wound structure, or layers of unidirectional fiber reinforced prepreg. To ensure that mounting screws do not pull out of the mounting plate 30, it could be advantageous to place an additional layer of material 64 between the core 62 and the reinforcing layer 65. This additional layer could be a chopped fiberglass mat, as in the preferred embodiment or a number of other materials such as fiberglass cloth, Kevlar TM cloth, a metal sheet, a plastic sheet, or other similar materials.

In order to protect the interior structure and cosmetically enhance the ski, a protective side wall 68 and top surface 66 are then placed around the core and reinforcing layers. It will be understood that for cosmetic reasons, the top surface 66 will typically be formed of the same conventional material used to form the top surface of the shovel and tail of the ski, for example, ABS or ABS/urethane. After laying up the mounting plate 30, the combined assembly including the body of the ski, the viscoelastic material, and the mounting plate are then cured as a combined assembly under proper temperatures and pressures for the resins or adhesives used throughout the structure. In the preferred embodiment, the combined assembly is cured as one piece, however, the mounting plate and body of the ski could be cured separately and then bonded to the viscoelastic layer 60 using a suitable adhesive as described above.

The recess 32 and mounting plate 30 are sized such that they are long enough to be used as a mounting plate for a conventional ski binding. In addition, the thickness of the mounting plate is sized such that it is thick enough to contain the fasteners 22, used to mount the ski bindings, within the depth of the mounting plate, thus preventing the fasteners from piercing the layer 60 or the body of the ski.

The toe and heel bindings 16 and 18 are illustrated representations only and it is contemplated that the invention will be usable with all standard release bindings. As illustrated, both the toe binding 16 and the heel binding 18 are fixedly secured to the mounting plate 30 through the use of fasteners 22. The fasteners 22 could be any type of screw fastener capable of being secured within the mounting plate without piercing the layer 60 or the body of the ski. In the preferred embodiment, the mounting plate 30 is 9 millimeters thick and is intended to be used with conventional 8 millimeter long binding screws.

The use of the mounting plate 30 allows a relatively stiff, structurally solid mounting surface to be used to mount the bindings to the ski. This prevents the fasteners from being pulled loose from the ski under the significant stresses commonly encountered during skiing. Furthermore, the use of a separate mounting plate 30 and viscoelastic layer 60 to isolate the bindings and ski boot from the ski body creates significant advantages. In a standard ski, the mounting of different brands and types of ski bindings upon the ski affects the flexing of the ski. Therefore, in order to ensure proper performance, a skier may have to try a number of different combinations of skis and bindings in order to get the characteristics desired. In the present invention, the bindings are isolated from the ski body, therefore selection of bindings does not significantly affect the flexing, or performance of the ski.

In addition, the present invention allows the ski to flex over its entire length in the fashion for which it was designed. The effects of the flat or relatively inflexible portions of a ski created by prior binding mounting techniques are eliminated. Furthermore, the viscoelastic material serves to dampen high frequency vibrations that would otherwise be transmitted through the bindings to the skier. All these advantages are gained without the addition of unsightly plates mounted on top of the ski which change the side profile of the ski and affect the ski's performance.

It will be understood that while the present invention finds its principal application in connection with snow skis, the concept disclosed may also be applied to snowboards, since snowboard bindings are also typically screwed into the body of the board with consequent reduction in edge control.

While the preferred embodiment of the invention has been illustrated and described, it will be appreciated that various changes can be made therein without departing from the spirit and scope of the invention. As an example, the materials used to fabricate the body of the ski or the mounting plate could be changed. Similarly, the shape of the mounting plate or recess could be changed.

The embodiments of the invention in which an exclusive property or privilege is claimed are defined as follows:

1. A board, such as a snow ski or snowboard for use on snow or ice, the board comprising:

(a) a longitudinally extending structural but flexing body having a core and an outer layer enclosing said core, said structural body having a top surface formed by said outer layer with an upwardly opening recess therein;

(b) plate means for mounting a boot binding thereon, said plate means being positioned in said recess;

(c) a viscoelastic layer positioned between said body and said plate means such that said plate means is isolated from direct contact with said body; and (d) means for attaching said body, said plate means and said viscoelastic layer together to permit flexing of said body relative to said plate means by viscoelastic deformation of said viscoelastic layer.

2. The board of claim 1, wherein said binding is mounted to said plate means with screw-type fasteners, and wherein said plate means has a thickness sufficient to receive said fasteners such that said fasteners do not extend into said body.

3. The board of claim 1, wherein said body includes a laterally narrowed waist portion and said recess is positioned at said waist portion.

4. The board of claim 1, wherein said plate means is complementarily shaped to fill said recess such that the top surface of said plate means forms a smooth continuation of the top surface of the body at opposite ends of said recess.

5. The board of claim 1, wherein said plate means is sized to receive a ski binding mounted thereon.

6. The board of claim 1, wherein said viscoelastic layer is a sheet of urethane.

7. The board of claim 1, wherein said means for attaching said body, said plate means and said viscoelastic layer together is a thermosetting resin.

8. The board of claim 3, wherein said body further includes means for reinforcing the waist portion.

9. A snow ski comprising:

a) a longitudinally extending structural but flexing body having a shovel portion, a waist portion and a tail portion, the body including a core and reinforcing material wrapped around and bonded to said core, said body having a top surface including a recess opening upward in said waist portion;

b) a mounting plate adapted to fill said recess and to receive and hold a ski binding by means of at least one fastener;

c) a viscoelastic layer positioned in said recess between said mounting plate and said body such that the viscoelastic layer isolates said mounting plate from direct contact with said body; and, d) means for bonding said viscoelastic layer to said mounting plate and said body to permit flexing of said body relative to said mounting plate by viscoelastic deformation of said viscoelastic layer.

10. The snow ski of claim 9, wherein said mounting plate is adapted to receive and hold said fastener mounting said ski binding to said mounting plate such that said fastener does not extend into said body.

11. The snow ski of claim 9, wherein said mounting plate further comprises a core wrapped with a fiberglass material, said fiberglass material being bonded to said core by resin.

12. The snow ski of claim 9, wherein said mounting plate further includes reinforcing material for assisting in retaining said fastener therein.

13. The snow ski of claim 9, wherein said body further includes means for reinforcing said waist portion.

14. The board of claim 2, wherein said plate means has a thickness to receive said fasteners totally within said plate means such that said fasteners do not extend into said viscoelastic layer.

15. The snow ski of claim 10, wherein said mounting plate is adapted to receive and hold said fastener mounting said ski binding to said mounting plate such that said fastener does not extend into said viscoelastic layer.

16. A board, such as a snow ski or snowboard for use on snow or ice, the board comprising:

(a) a longitudinally extending structural but flexing body having a core and an outer layer enclosing said core, said structural body having a top surface with an upwardly opening recess therein;

(b) plate means for mounting a boot binding thereon, said plate means being adapted to be positioned in said recess;

(c) a viscoelastic layer positioned between said body and said plate means such that said plate means is isolated from direct contact with said body; and (d) means for attaching said body, said plate means and said viscoelastic layer together to permit flexing of said body relative to said plate means by viscoelastic deformation of said viscoelastic layer;

wherein said binding is mounted to said plate means with screw-type fasteners, and wherein said plate means has a thickness sufficient to receive said fasteners such that said fasteners do not extend into said body.

17. A board, such as a snow ski or snowboard for use on snow or ice, the board comprising:

(a) a longitudinally extending structural but flexing body having a core and an outer layer enclosing said core, said structural body having a top surface with an upwardly opening recess therein;

(b) plate means for mounting a boot binding thereon, said plate means being adapted to be positioned in said recess;

(c) a viscoelastic layer positioned between said body and said plate means such that said plate means is isolated from direct contact with said body; and (d) means for attaching said body, said plate means and said viscoelastic layer together to permit flexing of said body relative to said plate means by viscoelastic deformation of said viscoelastic layer;

wherein said plate means is complementarily shaped to fill said recess such that the top surface of said board comprises a smooth continuation of the top surface of the body at opposite ends of said recess.

18. A board, such as a snow ski or snowboard for use on snow or ice, the board comprising:

(a) a longitudinally extending structural but flexible body having a core and an outer layer enclosing said core, said structural body having a top surface with an upwardly opening recess therein;

(b) plate means for mounting a boot binding thereon, said plate means being adapted to be positioned in said recess;

(c) a viscoelastic layer positioned between said body and said plate means such that said plate means is isolated from direct contact with said body; and (d) means for attaching said body, said plate means and said viscoelastic layer together to permit flexing of said body relative to said plate means by viscoelastic deformation of said viscoelastic layer;

wherein said body includes a laterally narrowed waist portion and said recess is positioned at said waist portion, and wherein said body further includes means for reinforcing said waist portion.

* * * * *